US005500569A

United States Patent [19]

Blomberg et al.

[11] Patent Number: 5,500,569

[45] Date of Patent: Mar. 19, 1996

[54] ELECTRICALLY MODULATABLE THERMAL RADIANT SOURCE AND METHOD FOR MANUFACTURING THE SAME

[75] Inventors: Martti Blomberg, Vantaa; Markku Orpana, Espoo; Ari Lehto; Anssi Korhonen, both of Helsinki, all of Finland

[73] Assignees: Instrumentarium Oy; Vaisala Oy, both of Helsinki, Finland

[21] Appl. No.: 220,696

[22] Filed: Mar. 31, 1994

[30] Foreign Application Priority Data

Apr. 7, 1993 [FI] Finland ..... 931570

[51] Int. Cl.[6] ..... H01K 1/04

[52] U.S. Cl. ..... 313/578; 313/522

[58] Field of Search ..... 313/578, 522

[56] References Cited

U.S. PATENT DOCUMENTS

| | | | |
|---|---|---|---|
| 3,604,971 | 9/1971 | Tracy | 313/522 |
| 3,715,785 | 2/1973 | Brown et al. | 313/522 |
| 4,338,281 | 7/1982 | Treitinger et al. | 422/98 |
| 4,378,489 | 3/1983 | Chabinsky et al. | 219/543 |
| 4,648,175 | 3/1987 | Metz, Jr. et al. | 29/589 |
| 4,719,477 | 1/1988 | Hess | 346/140 R |
| 4,724,356 | 2/1988 | Daehler | 313/522 |
| 5,285,131 | 2/1994 | Muller et al. | 313/578 |

OTHER PUBLICATIONS

Mastrangelo et al., "Electrical and Optical Characteristics of Vacuum–Sealed Polysilicon Microlamps," IEEE, vol. 39, No. 6, Jun. 1992, pp. 1363–1375.

Parameswaran et al., "Micromachined Thermal Radiation Emitter from a Commercial CMOS Process," IEEE, vol. 12, No. 2, Feb. 1991, pp. 57–59.

S. M. Sze, "VLSI Technology," Sections 5.11 and 6.10, 1985.

International Publication Number: WO91/10336 published 11 Jul. 1991.

Transducers. 11–14 Jun. 1985, H. Guckel and D. W. Burns, "Integrated transducers based on blackbody radiation from heated polysilicon filaments", pp. 364–366.

*Primary Examiner*—Sandra L. O'Shea
*Assistant Examiner*—Matthew J. Esserman

[57] ABSTRACT

A radiant source including an essentially planar substrate having a well or hole formed therein. At least one incandescent filament is mounted to the substrate and aligned at the well or hole. Contact pads are formed onto the substrate, to both ends of the incandescent filament, and feed electric current to the incandescent filament. Furthermore, each incandescent filament is doped with phosphorus to an impurity concentration of at least $5\times10^{19}$ atoms/cm$^3$.

13 Claims, 2 Drawing Sheets

FIG. 1a
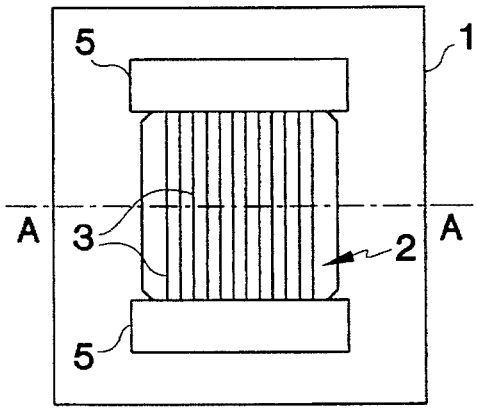
FIG. 2a
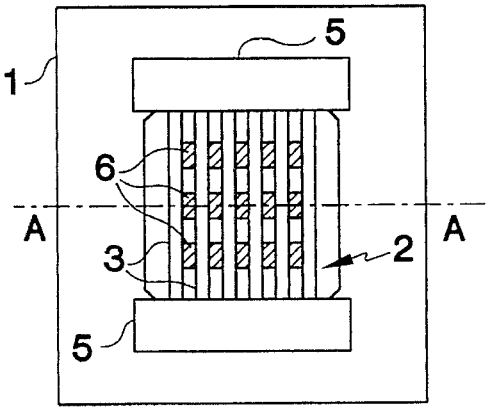
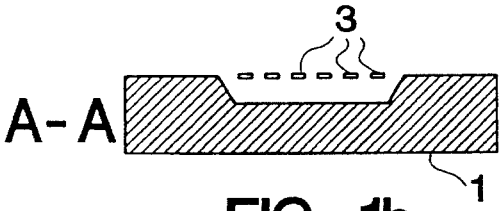
FIG. 1b
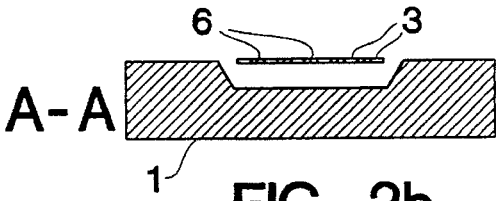
FIG. 2b
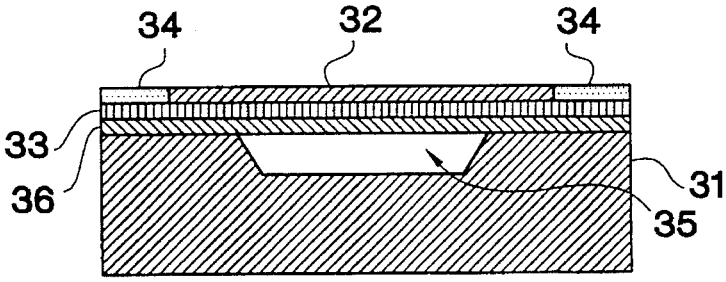
FIG. 3

ELECTRICALLY MODULATABLE THERMAL RADIANT SOURCE AND METHOD FOR MANUFACTURING THE SAME

BACKGROUND OF THE INVENTION

The present invention relates to an electrically modulatable thermal radiant source.

The invention also concerns a method for manufacturing the same.

Infrared radiant sources are used in optical analysis methods as IR radiation sources, and in some other applications as heat sources. Several different types of IR sources are used for the former application such as the "globar" source, the incandescent lamp and the thick-film radiator. The intensity of the radiation beam emitted by the IR source can be modulated by altering the source temperature through varying the input power to the source, or alternatively, using a mechanical beam interrupting device, called "chopper" simultaneously keeping the source temperature as constant as possible.

When a mechanically movable chopper is used for modulating the beam, the mean time between failure of the radiant source is usually limited by the chopper mechanism life, typically lasting from a year to two. An electrically modulated source provides a much longer time between failure.

Analogous to its name, a "globar" is a glowing bar. The bar is conventionally made from a ceramic material heated with electric current. A "globar" device typically is a few millimeters thick and a few centimeters long, whereby its thermal time constant is several seconds. The "globar" is not usually modulated by varying the power input to the device. The input power typically is in the range from a few watts to hundred watts. A variant of the "globar" device is a ceramic bar having a resistance wire wound about the bar. The thermal properties of the variant are equivalent to those of the simple "globar".

An incandescent lamp can be electrically modulated with frequencies up to a few ten Hz, even up to several hundred Hz, but the glass bulb of the lamp absorbs radiation in the infrared range and blackens in the long run, whereby the output intensity of radiation delivered by the lamp decreases with time. The required input power is typically from a few watts to tens of watts.

A thick-film radiator typically comprises a thick-film resistor formed onto an alumina substrate and heated by electric current. The size of the resistor typically is in the order of a few square millimeters with a thickness of half a millimeter. The thermal time constant of the resistor typically is in the order of seconds and the required power input is a few watts.

Conventional production techniques used in microelectronics and micromechanics provide the ability to produce miniature size, electrically modulatable radiant sources from silicon (see "Integrated Transducers Based on the Blackbody Radiation from Heated Polysilicon Films," by H. Guckel and D. W. Berns, Transducers 1985, 364–366 (Jun. 11–14, 1985); "Electrical and Optical Characteristics of Vacuum Sealed Polysilicon Microlamps," by Carlos H. Mastrangelo, James Hsi-Jen Yeh, and Richard S. Muller, IEEE Transactions on Electron Devices, 39, 6, 1363–1375 (June 1992); and "Micromachined Thermal Radiation Emitter From a Commercial CMOS Process," by M. Parameswaran, A. M. Robinson, D. L. Blackburn M. Gaitan, and J. Geist, IEEE Electron Device Lett., 12, 2, 57–59 (1991).

Such devices have a thin-film structure of polysilicon with a typical thickness of approx. one micrometer and a length of hundreds of micrometers. The width of the thin-film resistive element may vary from a few micrometers to tens of micrometers. The thermal capacity of such a silicon incandescent filament is low permitting its modulation with frequencies up to hundreds of hertzes. Pure silicon is an inferior conductor for electric current. However, by doping it with a proper dopant such as, e.g., boron or phosphorus, excellent conductivity is attained. Boron as a dopant is handicapped by the fact that its activation level is not stable, but rather, is dependent on the earlier operating temperature of the silicon incandescent filament. This causes the activation level to continually seek for a new equilibrium state, which means that the resistance of the filament drifts with time, and so does the input power to the filament unless the power input is not externally stabilized. The highest impurity concentration possible in silicon with boron as dopant is approx. $5 \cdot 10^{19}$ atoms/cm$^3$. Other conventional dopants are arsenic and antimony. A problem encountered with these elements as dopants is the difficulty in achieving adequately high impurity concentrations for attaining a sufficiently high conductivity for low-voltage use.

The incandescent filament discussed in the Guckel and Berns article referenced above is made by doping with phosphorus to achieve a sheet resistance greater than 50 Ω/square. The incandescent filament is 100 μm long, 20 μm wide and 1.2 μm elevated from the substrate. In such a structure, the radiant power loss over the air gap to the substrate is particularly high, and a high risk of the filament adhering to the substrate is evident as the filament sags during heating.

The structure of the incandescent filament discussed in cited publication 2 comprises encapsulation under a thin-film window and placing the incandescent filament in a vacuum to avoid burn-out. Such a window cannot be wider than a few tens of micrometers, whereby the total surface area of the filament, and accordingly, its radiant output remains small. To avoid adherence of the filament, a V-groove is etched into the substrate.

The IR emitter discussed in cited publication 3 has a size of 100 μm by 100 μm and uses two "meandering" polysilicon resistors as the heating element. Such a structure is prone to warp during heating, and large-area emitting elements cannot be manufactured by way of this concept. Though the heating element is contiguous, the gas bubbles emerging during the etching phase of the substrate cause no problems as the heating element size is small in comparison with the openings about it. However, the temperature distribution pattern of this structure is not particularly good as is evident from FIG. 2 of cited publication.

An incandescent filament made from doped polysilicon is associated with a characteristic temperature above which the temperature coefficient of the filament resistance turns negative, that is, allowing the filament to pass more current with rising temperature. Consequently, such a component cannot be controlled by voltage, but rather, by current. Neither can such filaments be connected directly in parallel to increase the radiant source surface as the current tends to concentrate on that filament having the lowest resistance, that is, highest temperature. Series connection on the other hand requires elevating the input voltage to a multiple of the single filament voltage. Boron doping cannot provide a satisfactorily high characteristic temperature, because a high boron impurity concentration achieves only approx. 600° C. characteristic temperature. If the operating temperature of the filament is higher than this, the filament resistance tends to drift with time.

SUMMARY OF THE INVENTION

It is an object of the present invention to overcome the disadvantages of the above-described prior-an techniques and to achieve an entirely novel electrically modulatable thermal radiant source and a method for manufacturing the same.

The invention is based on doping the incandescent filaments of a radiant source made from polycrystalline silicon so heavily with phosphorus that the characteristic temperature of the incandescent filaments is elevated substantially above the operating temperature of the filaments.

More specifically, the electrically modulatable thermal radiant source according to the invention is characterized by filaments doped with phosphorus to an impurity concentration of at least $5\times10^{19}$ atoms/cm$^3$.

Furthermore, the method according to the invention is characterized by forming a polysilicon layer into at least one incandescent filament which is doped with phosphorus to an impurity concentration of at least $5\times10^{19}$ atoms/cm$^3$.

The approach according to the invention achieves significantly better stability characteristics over boron-doped incandescent filaments. The activation level of phosphorus does not change with temperature, but instead, the sheet resistance remains constant at a given temperature. Consequently, as the filament resistance stays constant at the design temperature, such an incandescent filament is extremely stable in operation. A further benefit of the heavy doping with phosphorus is that the characteristic temperature rises substantially above the operating temperature (max. 800° C.). A corollary thereof is that the temperature coefficient of the filament remains positive over the entire operating temperature range, thus permitting parallel connection of the filaments and voltage-controlled operation thereof. The characteristic temperature of a phosphorus-doped filament may be in the order of 900° C. A still further benefit of heavy doping with phosphorus is that the operating voltage of the filament is lower than that of a boron-doped filament with a corresponding geometry. Additionally, owing to the heavy doping with phosphorus, the high concentration of free charge carriers makes the incandescent filament optically more opaque than can be achieved by doping with boron, which is a most advantageous property with regard to the present application.

The nitride encapsulation used in the manufacturing method according to the invention assures a long service life for the radiant source.

BRIEF DESCRIPTION OF THE DRAWINGS

The invention is next examined in greater detail with the help of exemplifying embodiments illustrated in the appended drawings, in which FIG. 1*a* is a top view of a radiant source according to the invention;

FIG. 1*b* is section A—A of the radiant source illustrated in FIG. 1*a;*

FIG. 2*a* is a top view of another radiant source according to the invention;

FIG. 2*b* is section A—A of the radiant source illustrated in FIG. 2*a;*

FIG. 3 is a sectional side view of the layered structure of a radiant source according to the invention.

DETAILED DESCRIPTION OF THE PREFERRED EMBODIMENTS

Figure 4:
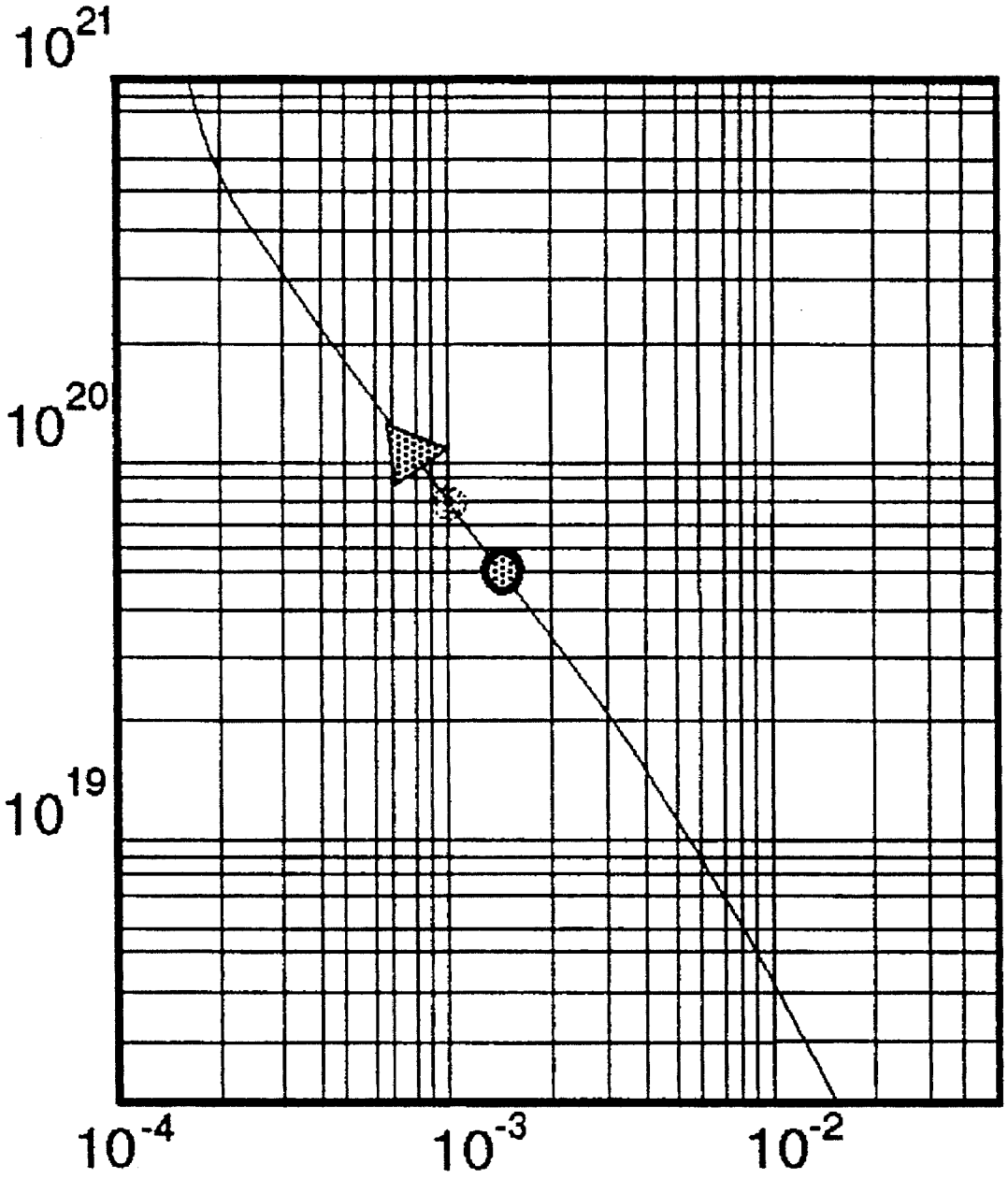
FIG. 4 is a graph of the resistivity dependence of polysilicon on the phosphorus impurity concentration.

The invention is intended for use in optical analysis as a thermal radiant source electrically modulatable at a high rate.

The embodiment according to the invention uses such a heavy phosphorus impurity concentration that the sheet resistivity of the incandescent filament is 10 Ω or lower, typically 5 Ω/square, whereby the resistivity of a 1 μm thick film is 0.001 Ωcm. The phosphorus impurity concentration can be even tenfold higher than that available with boron doping. The sheet resistivity according to the invention is achieved by means of phosphorus doping concentrations greater than $5\cdot10^{19}$ atoms/cm$^3$.

Phosphorus doping and deposition of different film layers required can be made using conventional standard processes of microelectronics (see "VLSI Technology," by S. M. Sze, McGraw-Hill Book Company, third printing 1985, chapters 5 and 6).

With reference to FIGS. 1*a* and 1*b* as well as FIGS. 2*a* and 2*b*, the structure of such a radiant source is shown in which a plurality of incandescent filaments are electrically connected in parallel.

With reference to FIG. 1*a*, a monocrystalline silicon chip is denoted by a large square 1, while a well formed under incandescent filaments 3 is denoted by a bevelled square 2; obliquely hatched area 6 in FIGS. 2*a* and 2*b* is nitride. The incandescent filaments 3 and metallized pads 5 at their ends are drawn with a black line. The filaments 3 are connected in parallel and the input voltage is applied to the metallized pads 5. FIGS. 1*a* and 1*b* illustrate a structure in which the filaments 3 are detached along their entire length from each other. An improved structure shown in FIGS. 2*a* and 2*b* has a silicon nitride bridge 6 mechanically interconnecting the filaments 3 to each other. The openings of the bridge are required to facilitate easier escapement of the gas evolving during etching from under the filaments. The end result of the etching step is improved herein. If a slow etching rate is used, the openings are redundant.

The emitting area can be, e.g., 1 mm$^2$. The incandescent filaments 3 are floating in the air for their entire length supported only at their ends. The silicon 1 under the filaments 3 is etched away for a depth of at least 10 μm, typically of 100 μm. The ends of the filaments 3 are connected in parallel by means of the metallized pads 5, respectively placed at each end. The dimensions of the filaments 3 can be, e.g., thickness 1 μm by width 20 μm by length 1 mm, and a spacing of 5 μm between the filaments. The filaments 3 are heated by the current flowing via them. The required input voltage is a few volts.

According to the invention, polysilicon incandescent filaments 3 which are heavily doped with phosphorus are entirely encapsulated in silicon nitride, whereby the oxidation rate of the nitride determines the service life of the filament 3. If the radiant source is used at a temperature below 800° C. in normal room air, its service life is greater than ten years. No special vacuum environment with the necessary output window is required.

If heavy doping with boron according to the art is used, the underetching of the incandescent filaments can be made without nitriding of the filament, because silicon heavily doped with boron is resistant to etching in an aqueous solution of KOH. However, when doping with phosphorus is used, the filaments 3 must be protected against the etchant with the help of, e.g., nitride formed about the filaments. The etchant used can also be tetramethylammonium hydroxide, or alternatively, an aqueous solution of ethylenediamine with a small amount of pyrocatechol added.

As the incandescent filaments 3 operate without a superimposed window, any organic contamination falling on the filament 3 is burnt away. If the radiant source is operated in a pulsed mode, the air under the incandescent filaments heats up rapidly and blows any entrapped dust away. Accordingly, the embodiment according to the invention incorporates an inherent self-cleaning mechanism.

The crosswise temperature distribution of the incandescent filament 3 can be tuned by varying the design geometry. An even temperature distribution is attained by having the filament width at 20 μm or narrower. The crosswise temperature distribution can further be improved by thermally interconnecting the filaments 3 with each other by means of, e.g., the silicon nitride bridge 6.

The maximum usable modulation rate of the radiant source is dependent on the proportion of thermal losses. The majority of such losses occurs via the air layer below the filaments 3 and via the filament ends to the silicon substrate. As the proportion of radiant losses in the total loss is at a few per cent, the temperature of the incandescent filament 3 is an almost linear function of the input power. The maximum rate of modulation can be easiest tuned by varying the depth of the well 2 under the filaments 3. Suitable range for the depth of the well is 50–300 μm. With the structure described herein, a thermal time constant of approx. 1 ms can be attained permitting electrical modulation up to approx. 1 kHz.

With reference to FIG. 3, the layered structure of the radiant source is shown in greater detail. Area 31 typically is formed by a substrate chip of (100)-oriented monocrystalline silicon having a typically 200 nm thick silicon nitride layer 36 deposited on it. The nitride layer 36 is required to isolate the incandescent filaments from the conducting substrate 31. When a dielectric substrate material is used, the isolating layer 36 is obviously redundant outside the well area. Onto the surface of the isolating layer 36 is deposited a typically 1 μm thick polysilicon layer 33 doped with phosphorus. Subsequently, the polysilicon layer 33 is patterned into the incandescent filaments by means of photolithography and plasma etching techniques used in microelectronics manufacture. Next, an upper silicon nitride layer 32 is deposited, whereby the incandescent filaments patterned from the polysilicon layer 33 become entirely encapsulated within a nitride layer. Means for feeding the input voltage comprise metallized pads 34, which can be made of aluminum, for example. These pads form ohmic contacts with the polysilicon elements 33 via openings made into the upper nitride layer 32 by means of, e.g., plasma etching. The monocrystalline silicon forming the substrate 31 is finally etched away from under the filament, whereby a well 35 is formed. This etching step occurs via openings made between the filaments and at the side of the outermost filaments.

The emissivity of the radiant source can be improved by coating the incandescent filaments with, e.g., tungsten, which can be sputtered onto the upper nitride layer 32 prior to the etching of the well 35. As the filaments are heated first time in air, the metallization is oxidized. As is known, an oxide has a higher IR emissivity than a nitrided polysilicon film alone.

With reference to FIG. 4, the resistivity dependence of polysilicon on phosphorus impurity concentration is a monotonous function. The benefits of the invention are attained using an impurity concentration greater than or equal to $5 \cdot 10^{19}$ atoms/cm$^3$. Advantageous results are obtained with an impurity concentration of $8 \cdot 10^{19}$ atoms/cm$^3$. According to the diagram (small hatched marking), such a dopant concentration corresponds to a resistivity of smaller than or equal to 0.001 Ωcm.

Without departing from the scope and spirit of the invention, the incandescent filaments can alternatively be connected, e.g., pairwise in series by placing the two input voltage feed pads to one side of the substrate well, while each adjacent pair of the incandescent filaments is then electrically connected in series by joining their other ends on the other side of the well.

Further, the well under the filaments can be replaced within the scope of the invention by a hole extending through the substrate.

Alternative substrate materials with dielectric properties are such as alumina, sapphire, quartz and quartz glass.

Alternative substrate materials with conducting properties are, e.g., metals.

We claim:

1. An electrically modulatable radiant source comprising:

an essentially planar substrate having a well or hole formed into the substrate, at least one incandescent filament mounted to the substrate, said filament being aligned at said well or hole, contact pads formed onto the substrate, to both ends of the incandescent filament, for feeding electric current to the incandescent filament, and wherein each of the incandescent filaments is doped with phosphorus to an impurity concentration of at least $5 \times 10^{19}$ atoms/cm$^3$.

2. A radiant source as defined in claim 1 wherein the substrate comprises polycrystalline silicon, and each incandescent filament doped with phosphorus to an impurity concentration of at least $5 \times 10^{19}$ atoms/cm$^3$ is made of polysilicon.

3. A radiant source as defined in claim 1 wherein least two of the incandescent filaments are electrically connected in series.

4. A radiant source as defined in claim 1, wherein at least two of the incandescent filaments are electrically connected in parallel.

5. A radiant source as defined in claim 1, wherein each of the incandescent filaments are conformantly enclosed under a contiguous silicon nitride layer for parts floating free from the substrate.

6. A radiant source as defined in claim 4 wherein the incandescent filaments are mechanically interconnected to each other.

7. A radiant source as defined in claim 6, wherein the incandescent filaments are mechanically interconnected to each other by means of a contiguous silicon nitride bridge (6).

8. A radiant source as defined in claim 6, wherein the incandescent filaments are mechanically interconnected to each other by means of a contiguous silicon nitride bridge having openings therein.

9. A radiant source as defined in claim 1, wherein each of the incandescent filaments is permitted to freely communicate with ambient air.

10. A radiant source as defined in claim 1, wherein the incandescent filaments are coated with a metal oxide layer.

11. A radiant source as defined in claim 1, wherein said substrate has a well formed therein, and said well has a depth of at least 10 μm.

12. A radiant source as defined in claim 1, wherein said substrate has a well formed therein, and said well has a depth of between 50–300 μm.

13. A radiant source as defined in claim 1, wherein each of the incandescent filaments is doped with phosphorus to an impurity concentration of $8\times10^{19}$ atoms/$cm^3$.

* * * * *